US009450319B2

(12) United States Patent
Nishimura

(10) Patent No.: US 9,450,319 B2
(45) Date of Patent: Sep. 20, 2016

(54) CABLE CONNECTOR AND CONNECTOR DEVICE HAVING THE SAME

(71) Applicant: Hirose Electric Co., Ltd., Tokyo (JP)

(72) Inventor: Hiroaki Nishimura, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 33 days.

(21) Appl. No.: 14/133,981

(22) Filed: Dec. 19, 2013

(65) Prior Publication Data

US 2014/0187085 A1 Jul. 3, 2014

(30) Foreign Application Priority Data

Dec. 27, 2012 (JP) ..... 2012-284340

(51) Int. Cl.

| | |
|---|---|
| ***H01R 12/75*** | (2011.01) |
| ***H01R 13/627*** | (2006.01) |
| *H01R 103/00* | (2006.01) |
| *H01R 12/70* | (2011.01) |
| *H01R 13/506* | (2006.01) |
| *H01R 12/59* | (2011.01) |

(52) U.S. Cl.

CPC ..... *H01R 12/75* (2013.01); *H01R 13/6273* (2013.01); *H01R 12/592* (2013.01); *H01R 13/506* (2013.01); *H01R 23/662* (2013.01); *H01R 2103/00* (2013.01)

(58) Field of Classification Search

CPC H01R 13/506; H01R 23/662; H01R 12/592; H01R 2103/00

USPC ..... 439/579, 466, 497, 865, 578

See application file for complete search history.

(56) References Cited

U.S. PATENT DOCUMENTS

| | | | | |
|---|---|---|---|---|
| 2006/0094306 | A1* | 5/2006 | Masaki | H01R 12/75 439/850 |
| 2008/0227334 | A1* | 9/2008 | Yoshioka | H01R 12/598 439/580 |
| 2010/0227511 | A1* | 9/2010 | Qian | H01R 9/03 439/656 |
| 2013/0244503 | A1* | 9/2013 | Yamaguchi | H01R 13/432 439/733.1 |

FOREIGN PATENT DOCUMENTS

| | | | |
|---|---|---|---|
| JP | 2005-158730 | A | 6/2005 |
| JP | 2008-262773 | A | 10/2008 |
| JP | 2009-037955 | A | 2/2009 |
| JP | 2010-092811 | A | 4/2010 |
| JP | 2012-109271 | A | 6/2012 |

* cited by examiner

*Primary Examiner* — Abdullah Riyami
*Assistant Examiner* — Justin Kratt
(74) *Attorney, Agent, or Firm* — Kubotera & Associates, LLC

(57) ABSTRACT

A cable connector is to be connected to a cable and having a fitting surface to be fitted to a mating connector along an axial direction of the cable. The cable connector includes a housing; and contact members secured in the housing. Each contact member includes a basal section extending along the axial direction; a connecting section provided on one side and connected to one end of the cable; a contact section provided on the other side in the axial direction relative to the basal section; and a section to be locked and provided between the basal section and the connecting section along the axial direction. When the contact member is placed in the housing by the sliding movement, a part of each section to be locked on a side opposite the moving destination side in the sliding direction will be locked by a predetermined part of the housing.

15 Claims, 14 Drawing Sheets

CABLE CONNECTOR AND CONNECTOR DEVICE HAVING THE SAME

BACKGROUND OF THE INVENTION AND RELATED ART STATEMENT

The present invention relates to a cable connector for using connecting to one end of a cable. Especially, the present invention relates to a so-called vertical-fitting type cable connector, which has a fitting surface for being fitted to a mating connector along an axial direction of a cable, and a connector device having the cable connector.

As a conventional vertical-fitting type cable connector, Patent Reference 1 has disclosed a conventional electrical connector. FIG. 12 is a perspective view showing the conventional electrical connector.

Patent Reference 1: Japanese Patent Application Publication No. 2010-92811

As shown in the appearance perspective view of FIG. 12, a conventional electrical connector 110 includes an insulating housing 11 extending as a thin strip; a conductive shell 113 that covers outside of the housing 111; and a plurality of plug modules 112 that connect to the electrical connector 110 through fitting connecting sections 111*a* provided in the insulating housing 111. Each plug module 112 works by itself as an independent coaxial connector.

FIG. 13 is a perspective view showing the conventional electrical connector viewed from a top rear-side thereof. FIG. 13 is a perspective view showing the conventional electrical connector viewed from a bottom rear-side thereof. As shown in the perspective view of FIG. 13 and the perspective view of FIG. 14, each plug module 112 includes a conducting contact 112*c*, which is connected to one end of a coaxial cable SC; an insulating module housing 112*b* that covers the cable SC; and a conductive shell 112*g* that further covers the module housing 112*b*.

Patent Reference 2 has disclosed another example of the conventional electrical connector, in which a contact is accommodated in a housing hole to lock and secure the contact therein. FIG. 15 shows a vertical sectional view of the locking configuration disclosed in Patent Reference 2.

Patent Reference 2: Japanese Patent Application Publication No. 2008-262773

According to the conventional electrical connector disclosed in Patent Reference 2, upon inserting a contact 102 in a contact housing hole 13 of a housing 101, a locking lance section 102*f* formed by cutting a part of the contact 102 along the insertion direction and lifting the part, which is in short formed to have a surface only on a side opposite the moving direction upon insertion, is caught by a lance stopper section 106 of the housing 101. With this hooking configuration, the contact 102 will be locked in the contact housing hole 103.

According to the conventional electrical connector disclosed in Patent Reference 1, the insulating housing 111, which is an insulating body of the electrical connector 110, and the module housings 112*b*, which are insulating bodies for the plug modules 112, are separately configured. As a result, the electrical connector 110 includes a large number of parts, and also requires a large number of assembling steps, so that there is an issue of a large device size.

In view of the problems, there is provided an invention, an object of which is to provide a cable connector capable of downsizing. In addition, another object of the present invention is to provide a cable connector, whereby it is possible to obtain sufficient locking strength in an axial direction of a cable. Furthermore, a further object of the present invention is to provide a cable connector, that has fewer parts and requires fewer assembling steps. Moreover, a still further object of the present invention is to provide a connector device using the cable connector.

Further objects and advantages of the present invention will be apparent from the following description of the present invention.

SUMMARY OF THE PRESENT INVENTION

In order to attain the objects described above, according to a first aspect of the present invention, a cable connector for connecting to one end of a cable and having a fitting surface to fit to a mating connector along an axial direction of the cable includes: a housing; and contact members, which are secured in the housing along a longitudinal direction of the fitting surface by sliding to the housing and connected to the cables. Each contact member includes a basal section extending along the axial direction of the cable; a connecting section, which is provided on one side and connected to one end of the cable; a contact section, which is provided on the other side in the cable's axial direction relative to the basal section; and a section to be locked, which is provided between the basal section and the connecting section along the axial direction of the cable and extends from the basal section side to the connecter fitting side. When the contact member is placed in the housing by the sliding movement, a part of each section to be locked on a side opposite the moving destination side in the sliding direction will be locked by a predetermined part of the housing.

According to the first aspect of the present invention, both the contact section and an elastically deforming section extend to the fitting side for fitting to the mating connector. Accordingly, the extending direction of the contact section can be used as a spring length of the elastic deformation section, and thereby it is possible to downsize the device in the fitting direction.

According to a second aspect of the present invention, each section to be locked includes a pair of elastic locking sections provided so as to face each other in a direction across the axial direction of the cable, while extending from the basal section side to the fitting side to fit to the mating connector. The width of the pair of facing elastic locking sections on the side opposite the destination side in the sliding direction can be set large on the fitting side for fitting to the mating connector relative to the basal section side. With this configuration, it is possible to obtain sufficient locking strength in the axial direction of the cable also with the elastic locking sections that require less space in the axial direction of the cable.

According to a third aspect of the present invention, the pair of facing elastic locking sections can be the ones that form a generally square-bottomed V-shape. With this shape, it is possible to easily form the elastic locking sections.

According to a fourth aspect of the present invention, the housing has a pair of facing wall sections, to which the pair of facing elastic locking sections is respectively locked. The size of a gap formed by the pair of facing wall sections is smaller than the maximum width of the pair of facing elastic locking sections on the fitting side for fitting to the mating connector. With this setting, the pair of facing elastic locking sections is locked by the housing.

According to a fifth aspect of the present invention, the pair of facing elastic locking sections can be the ones that are formed by cutting sheet metal and lifting the cut part and collide with the housing on the sheet surfaces thereof.

Although it makes it easy to produce the elastic locking sections by use of sheet metal, it is possible to obtain sufficient strength.

According to a sixth aspect of the present invention, the cable can be a coaxial cable.

According to a seventh aspect of the present invention, the cable connector can further include outer shells, each of which is secured onto the housing along the longitudinal direction of the fitting surface by sliding to the housing, and connected to an outer conductor of the coaxial cable.

According to an eighth aspect of the present invention, the contact members and the outer shells can be secured onto the housing by sliding along the axial direction of the coaxial cable. Accordingly, by inserting the contact members and the outer shells in the same direction, it is possible to reduce the number of parts and the number of assembling steps, and thereby it is possible to downsize the cable connector. Further, it is possible to assemble the device by sliding the contact members and the outer shells in the same directions, so that it is possible to simplify the assembling work.

According to a ninth aspect of the present invention, each contact member has a wide-width section, which is formed to have a wide width in a direction crossing the sliding direction, along the sliding surface of the housing, on which the contact member slides. The housing has a gap to insert the wide width section along the sliding surface. When the wide width section is inserted in the gap, the wide width section can be supported between the sliding surface and a part of the housing, which is provided on the fitting side for fitting of the cable connector to the mating connector relative to the wide width section. With this configuration, although the production can be simplified by the sliding movement, it is possible to prevent the contact members or the outer shells from coming off to the fitting side for fitting of the cable connector to the mating connector.

According to a tenth aspect of the present invention, each contact member can be housed in the housing slot of the housing excluding a soldering section that a core wire of the coaxial cable is to be connected. Surface of the housing slot extending in a direction of the sliding direction except a fitting-side surface can be covered with the outer shell. With this configuration, it is possible to securely shield the contact members from outside while being able to solder.

According to an eleventh aspect of the present invention, each soldering section has its both sides covered with side wall sections of the outer shell, which rise towards the fitting side for fitting of the cable connector to the mating connector. Those side wall sections are preferably provided to be away from the soldering section in comparison with the side wall sections of the outer shell that cover the both side surfaces of the housing slot, which are provided to rise towards the fitting side of fitting of the cable connector to the mating connector. With this configuration, it is possible to have a large insulating distance between the core wire and the outer shell.

According to a twelfth aspect of the present invention, there can be provided the housing between the contact member and the outer shell. With this configuration, it is not necessary to provide extra component and it is possible to electrically insulate between the contact member and the outer shell using the housing itself.

According to a thirteenth aspect of the present invention, there can be provided support sections that form a generally square-bottomed V-shape in the sectional view for supporting the coaxial cable. With the support sections, it is possible to reduce displacement upon soldering the coaxial cable, and to solder while keeping stable the core wire 24 of the coaxial cable, etc.

According to a fourteenth aspect of the present invention, it is possible to form a support base of the coaxial cable using the outer shell, on a side opposite the fitting side relative to the support sections. Even when it is difficult to completely support the coaxial cable with the support sections, it is possible to keep a position of the coaxial cable with the support base.

According to a fifteenth aspect of the present invention, the connecting section can be connected by soldering, and there can be provided space on a side opposite the fitting side for fitting the cable connector to the mating connector, in at least a part of the connecting sections. With the space, it is possible to release heat generated upon soldering, so that it is possible to reduce influence of heat on the housing, etc.

According to a sixteenth aspect of the present invention, there can be provided a plurality of the coaxial cables on the fitting surface. According to the configuration, it is achievable to downsize the device, so that it is possible to downsize the device even when a plurality of the coaxial cables is provided.

According to the present invention, it is possible to provide a cable connector that requires less space in the fitting direction and an axial direction of the cable. Furthermore, it is also achievable to obtain sufficient locking strength in the axial direction of the cable even with elastic locking sections designed to save space. In addition, it is also possible to provide a cable connector that can be made with less parts and made by fewer assembling steps.

Furthermore, it is possible to provide a connector device using such cable connector.

DETAILED DESCRIPTION OF THE PREFERRED EMBODIMENTS

Referring to the accompanying drawings, a cable connector according to a preferred embodiment of the present invention and a connector device having the cable connector will be described below.

Figure 1:
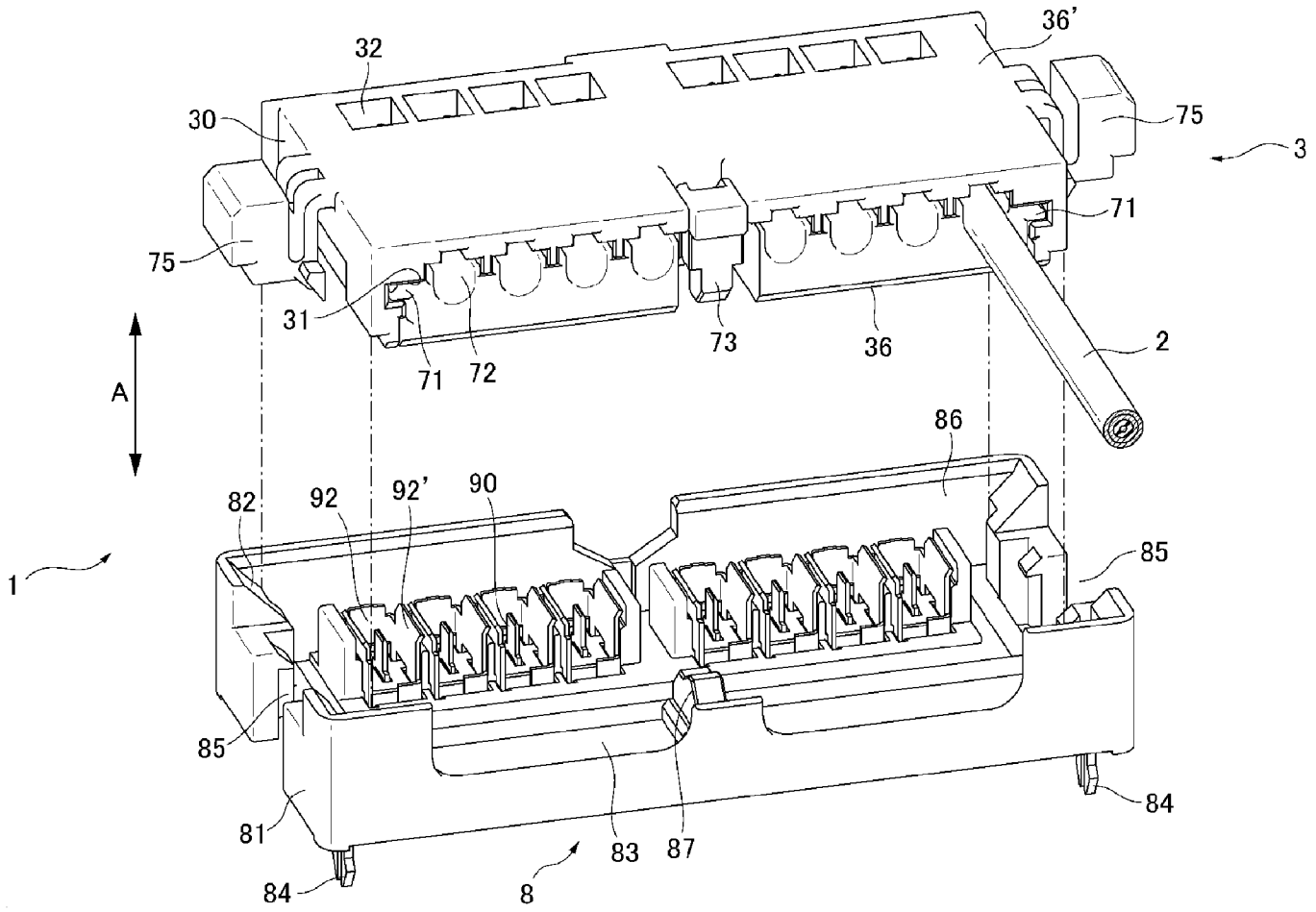
FIG. 1 is an appearance perspective view of a cable connector and a connector device according to an embodiment of the present invention.

FIG. 1 shows an appearance perspective view of a cable connector 3 according to the present invention, and a connector device 1 according to the present invention, which includes a set of the cable connector 3 and a board connector (mating connector) 8. The cable connector 3 and the board connector 8 can fit to each other so as to be able to freely attach/detach to/from each other. FIG. 1 shows a state of the cable connector 3 and the board connector 8 before fitting.

Upon use, one end of a coaxial cable 2 is connected to the cable connector 3. Here, FIG. 1 shows only one coaxial cable 2, but in actual use, one coaxial cable is disposed in each cable groove 72 provided in the cable connector 3, so that a plurality of the coaxial cables 2 are connected. On the other hand, the board connector 8 is used while being soldered onto a board (not illustrated) with terminal metal fittings 84 provided on the housing 81.

The cable connector 3 has a fitting surface 36 for fitting to the board connector 8, which extends along an axial direction of the coaxial cable 2. An upper side of the board connector 8 is opened. By putting the fitting surface 86 of the board connector 8 and the fitting surfaces 36 of the cable connector 3 together along the fitting direction using the cutout section, the cable connector 3 can fit to the opening of the board connector 8. Once the cable connector 3 is fitted in the board connector 8, the opening of the board connector 8 is closed with an upper surface 36' of the cable connector 3.

Upon fitting of the cable connector 3 and the board connector 8, protrusions 75 provided on left and right side surfaces of the cable connector 3 are matched to indented sections 85 provided on the left and right side surfaces of the housing 81 of the board connector 8. Then, using tapered guiding sections 82 provided on the housing 81 of the board connector 8, the cable connector 3 and the board connector 8 can be easily positioned. Here, even after fitting the cable connector 3 and the board connector 8 to each other, the coaxial cables 2 can be removed from the cable removal ports 83 provided on the housing 81 of the board connector 8.

Figure 2:
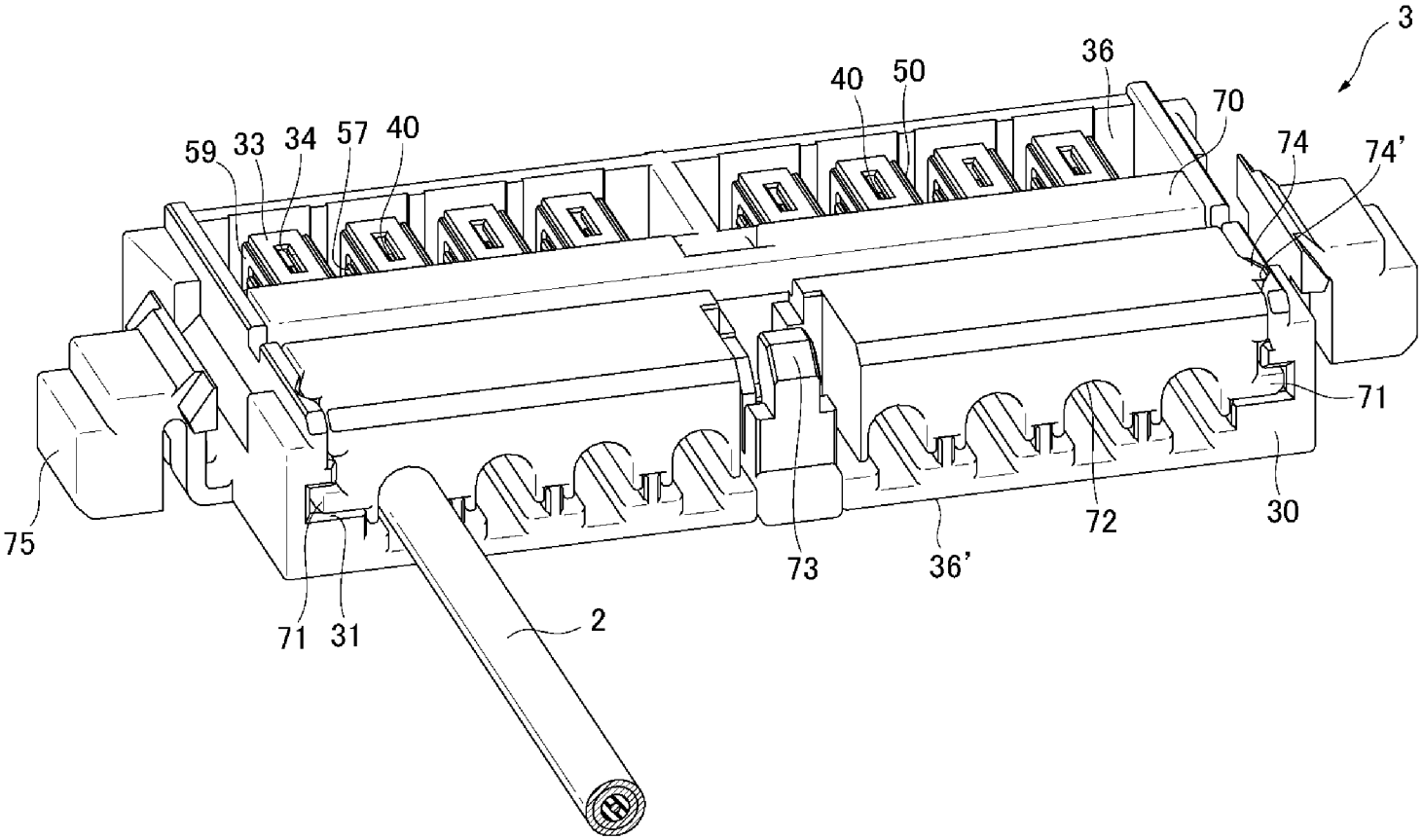
FIG. 2 is a rear-side perspective view of a fitting surface side of the cable connector according to the embodiment of the present invention.
Figure 3:
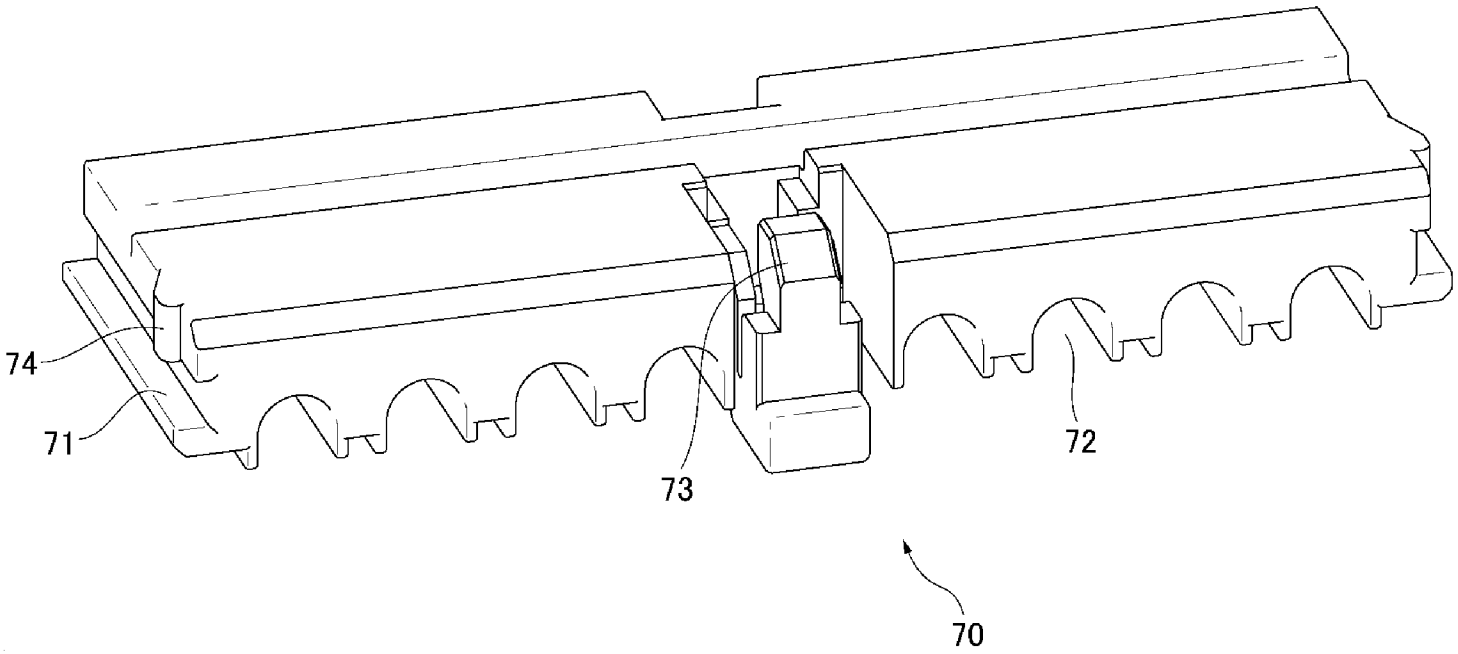
FIG. 3 is a rear-side perspective view of a sliding lid of the cable connector according to the embodiment of the present invention.

FIG. 2 is a rear-side perspective view showing the fitting surface 36 of the cable connector 3. FIG. 3 is a rear-side perspective view of a sliding lid 70 as a component for attaching to the cable connector 3.

A generally half of the fitting surface 36 of the cable connector 3 is covered with the sliding lid 70. Inserting a guiding plates 71 provided on both left and right side surfaces of the sliding lid 70 in guiding holes 31 provided on the housing 30 along the longitudinal direction of the fitting surface 36, the sliding lid 70 is guided to the cable connector 3 and attached thereto. In addition, the cable connector 3 and the board connector 8 are secured by hooking locking protrusions 74 provided on left and right side surfaces of the sliding lid 70 onto corresponding locking recesses 74' provided on the housing 3. Here, the cable grooves 72 are formed on the sliding lid 70.

Figure 5:
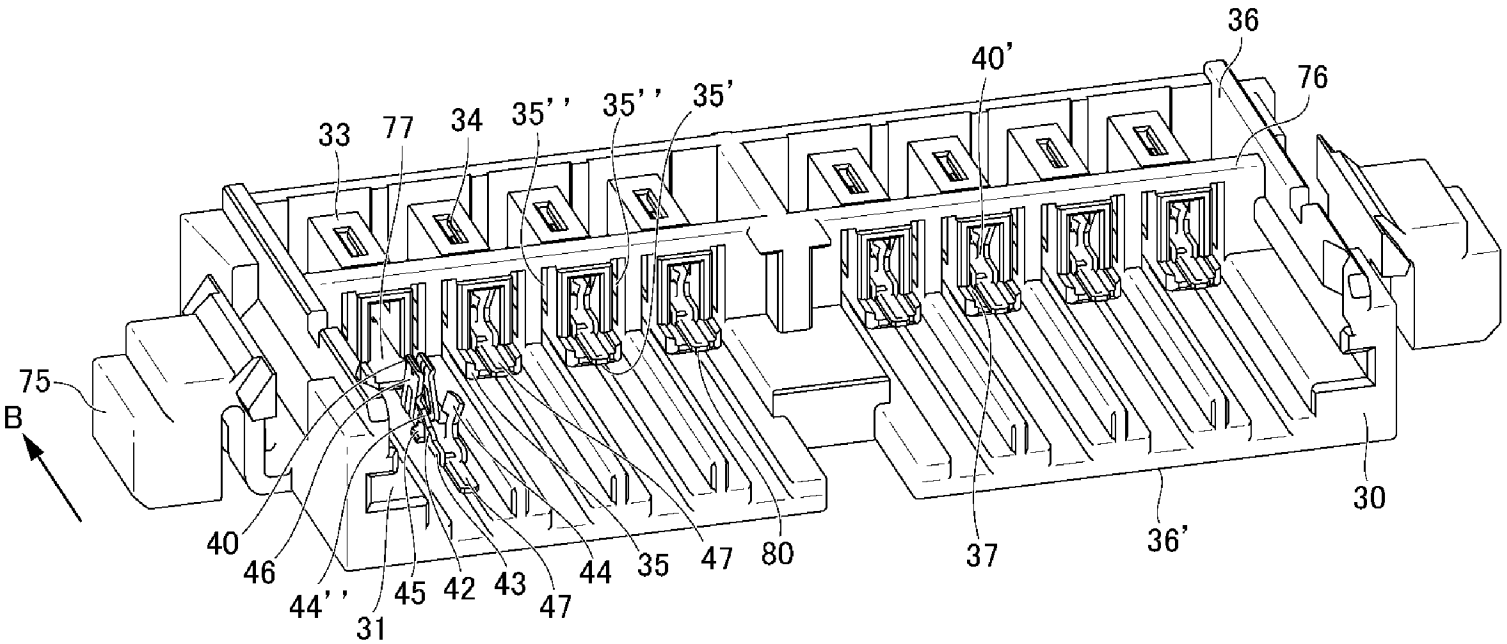
FIG. 5 is a schematic view No. 1 showing a process of attaching the contact members and an outer shell to the housing of the cable connector according to the embodiment of the present invention.

As also shown in FIG. 5, on the fitting surface 36 of the cable connector 3, a plurality of housing slots 33 are provided in a row corresponding to the coaxial cables 2. Inside the housing slots 33, each contact member 40 will be housed except a portion thereof (soldering section 47 in FIG. 9). Upon fitting the cable connector 3 and the board connector 8, the contact members 90 (see FIG. 1) of the board connector 8 enter inside of the housing slots 33 through the through holes 34 provided on the fitting surface 36 side of the housing slots 33, and connected thereto corresponding to a specified portion (pinching section 46 in FIG. 9) of each contact member 40 housed in the housing slot 33.

On the other hand, outside of each housing slot 33 is covered with a conducting outer shell 50. Upon fitting the cable connector 3 and the board connector 8, each outer shell 50 is guided inside of a conducting outer shell 92 (see FIG. 1) of the board connector 8 by guiding sections 92' that are provided on the outer shell 92, and connected to the outer shell 92.

Figure 4:
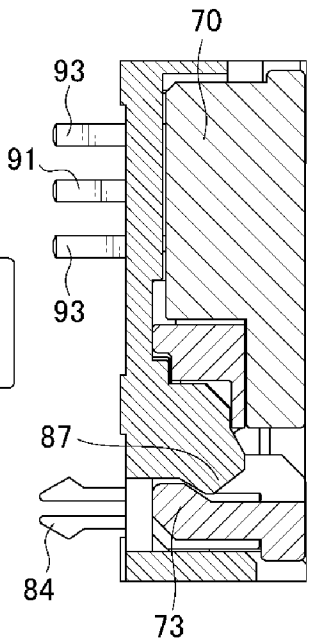
FIGS. 4(*a*) and 4(*b*) are views showing the cable connector according to the embodiment of the present invention, wherein FIG. 4(*a*) is a top view of the cable connector and a substrate connector that are fit to each other, and FIG. 4(*b*) is a sectional view thereof taken along the line 1-1.
Figure 4:
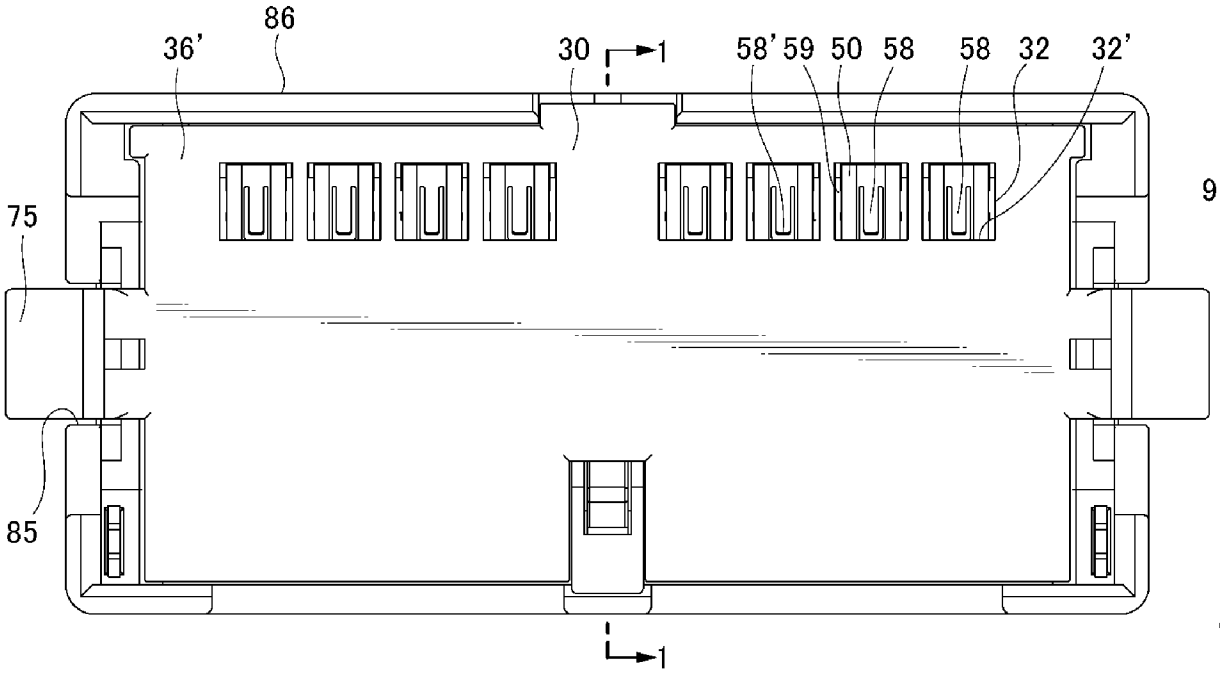

FIG. 4(*a*) shows a top view of the cable connector 3 and the board connector 8 in their fitted state, which is viewed from the upper surface 36', an opposite side to the fitting surface, of the cable connector 3. FIG. 4(*b*) shows a sectional view of FIG. 4(*a*) taken along the line 1-1, which means a sectional view taken along a center line of the sliding lid 70.

As well shown in FIG. 4(*a*), on the upper surface 36' of the cable connector 3, there are provided through holes 32 corresponding to respective outer shells 50. In each through hole 32, a part of each outer shell 50 (locking section 58) is exposed. In addition, as well shown in FIG. 4(*b*), upon fitting the cable connector 3 and the board connector 8, a locking protrusion 73 provided on the cable connector 3 and a locking protrusion 87 provided on the board connector 8 side are positioned so as to correspond to each other.

As a result, the cable connector 3 and the board connector 8 can securely remain fitted, while the sliding lid 70 is secured at the locking protrusions 74 of the sliding lid 70 and the locking recesses 74' of the housing 30 as described above referring to FIG. 2 etc. and secured inside the cable connector 3. Here, in FIG. 4(*b*), a board securing section 91 corresponds to a leg of each contact member 90, and the board securing sections 93 corresponds to a leg of the outer shell 92.

Referring to FIGS. 5 to 8, an inner configuration and assembling steps of the cable connector 3 will be described. The cable connector 3 includes a housing 30; contact members 40 and outer shells 50, which are secured in the housing 30. Here, each coaxial cable 2 is secured onto the contact member 40 and the outer shell 50.

FIG. 5 is a perspective view showing attachment of the contact members 40 to the housing 30. FIG. 5 shows all the contact members except one contact member 40 (i.e., seven contact members 40) being secured in corresponding housing slots 33 of the housing 30. The remaining one contact member 40 is further secured in a predetermined position around the housing slot 33 of the housing 30.

Figure 6:
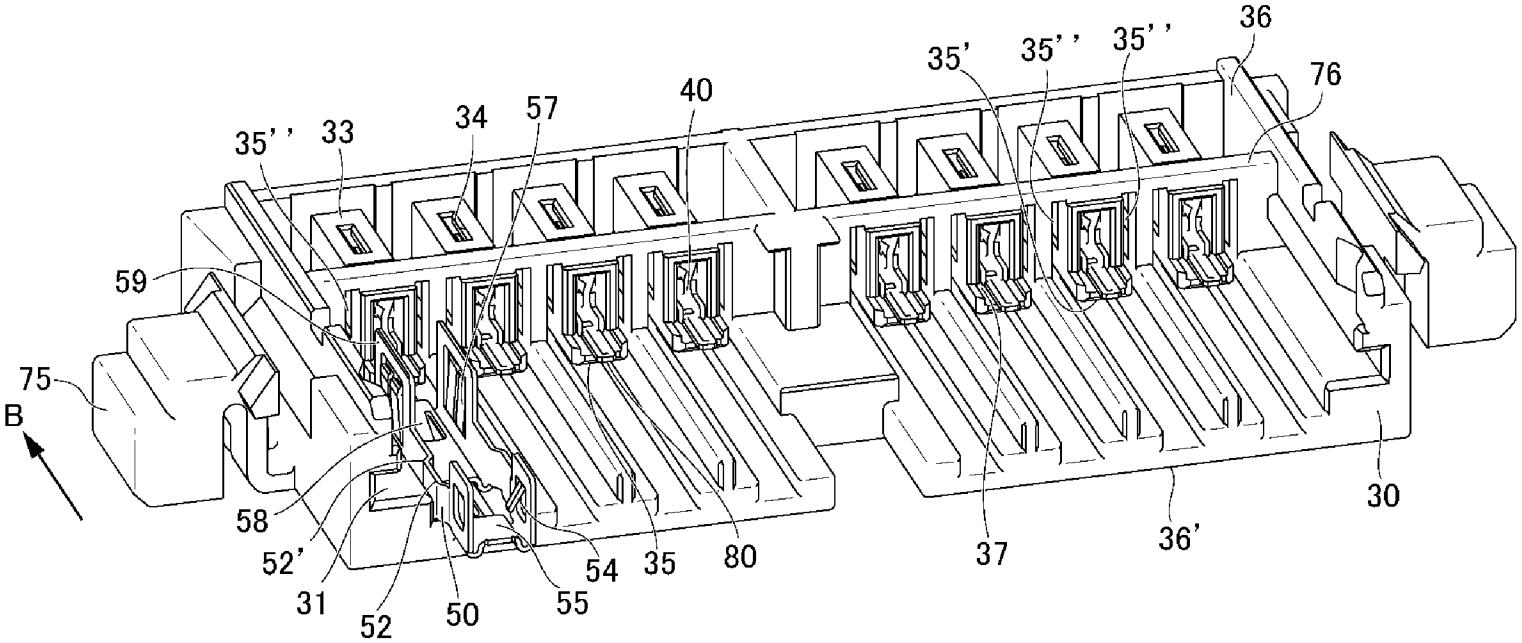
FIG. 6 is a schematic view No. 2 showing the process of attaching the contact members and the outer shell to the housing of the cable connector according to the embodiment of the present invention.

FIG. 6 shows a perspective view of attachment of the outer shell 50 to the housing 30 at an assembling step after that of FIG. 5. More specifically, it shows a state in which the first outer shell 50 is to be secured in a specified position near the housing slot 33 of the housing 30 after securing all the contact members 40.

Figure 7:
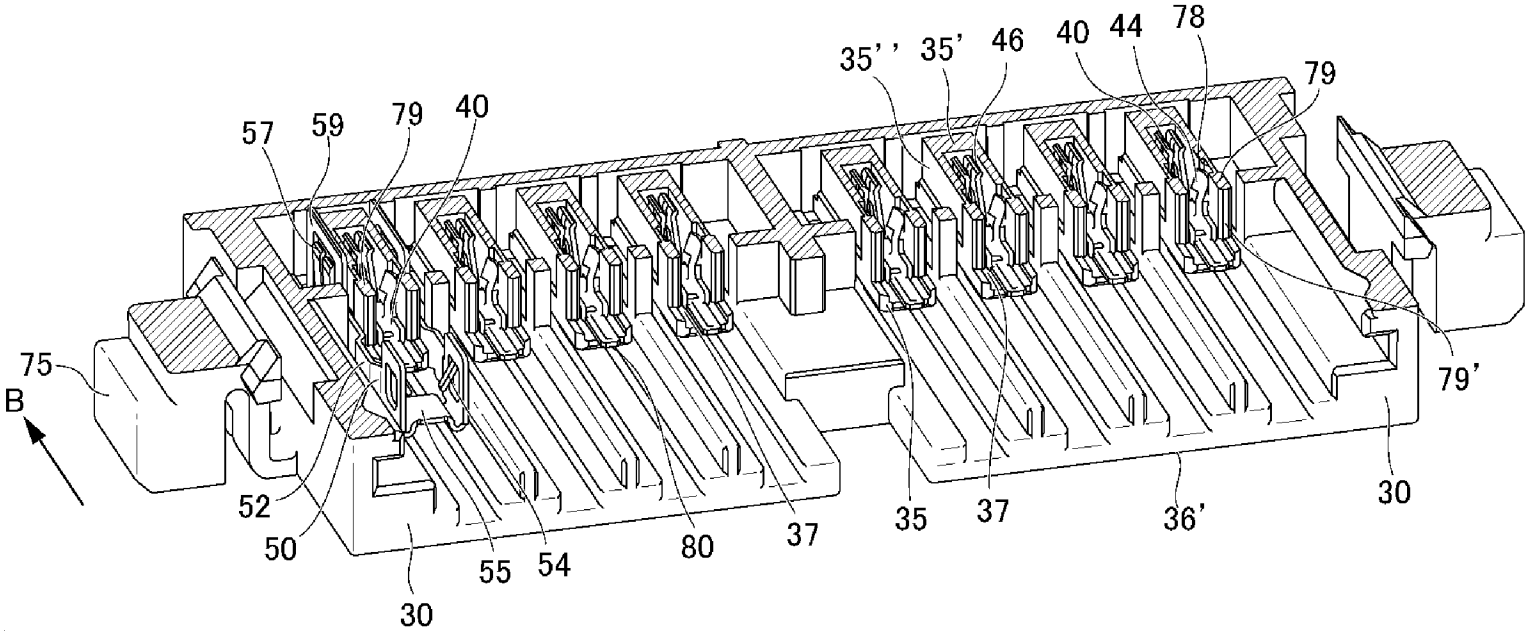
FIG. 7 is a schematic view No. 3 showing the process of attaching the contact members and the outer shell to the housing of the cable connector according to the embodiment of the present invention.
Figure 8:
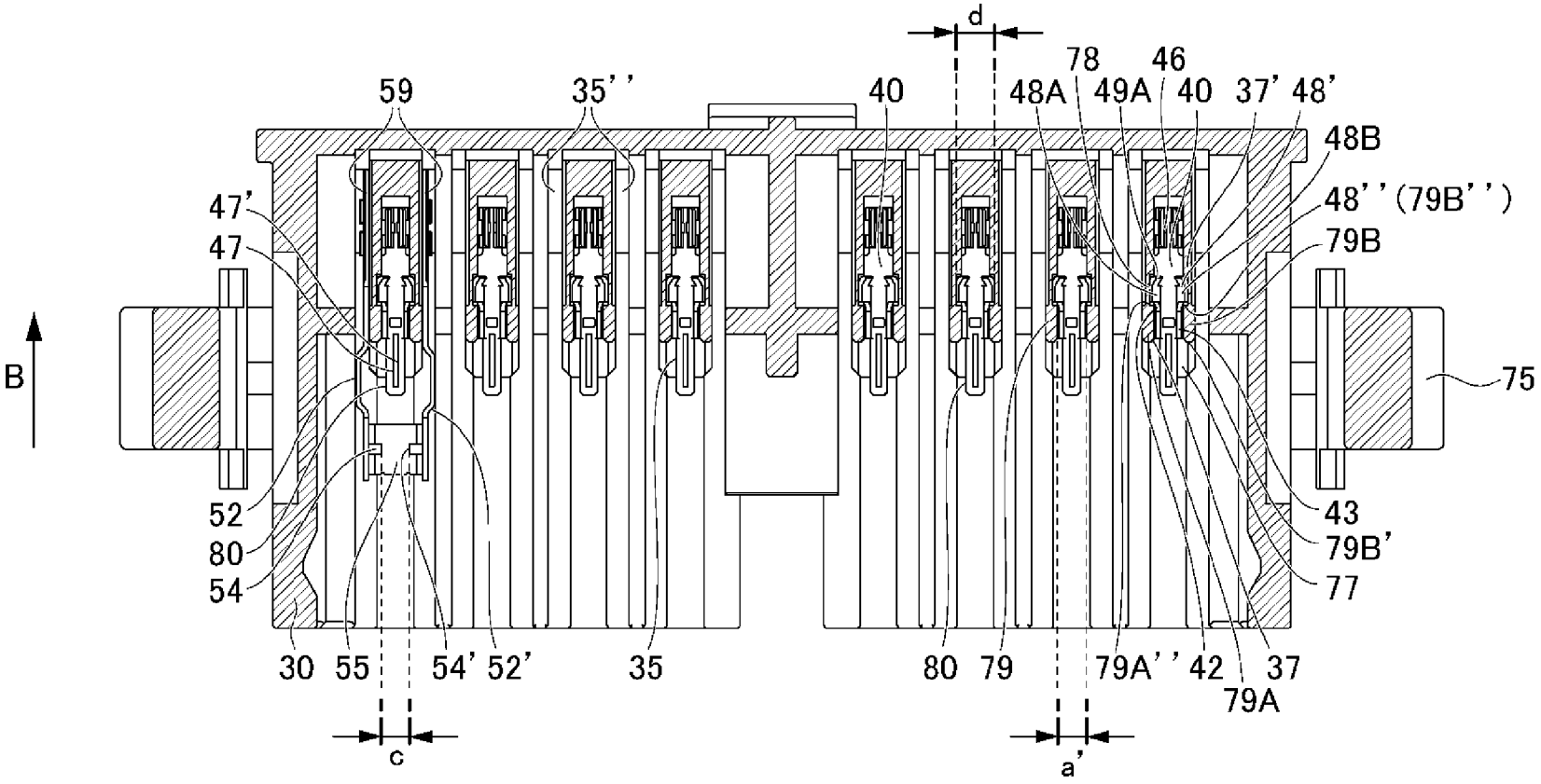
FIG. 8 is a top view showing the cable connector according to the embodiment of the present invention.

FIG. 7 shows a state, in which the first outer shell 50 is completely secured in a specified position of the housing 30, in a step after that of FIG. 5. Here, FIG. 7 shows a state, in which members above a reinforcing bar 76 of FIGS. 5 and 6 are excluded for convenience so as to easily see inside of the housing slot 33. FIG. 8 is a top view of FIG. 7.

As shown in FIGS. 5 to 8, both the contact members 40 and the outer shells 50 are secured in the housing 30, being slid along axial directions of the coaxial cables (not illustrated). The contact members 40 are slid along sliding surfaces 77 and the outer shells 50 are slid so as to surround specified surfaces of respective housing slots.

According to the configuration, it is possible to assemble the device by sliding the contact members 40 and the outer shells 50 in the same direction, and the assembling work can be simplified. In addition, the contact members 40 and the outer shells 50 are inserted in the same housing 30, so that it is possible to reduce not only the number of parts but also the number of assembling steps, and thereby it is also possible to downsize the device.

Figure 9:
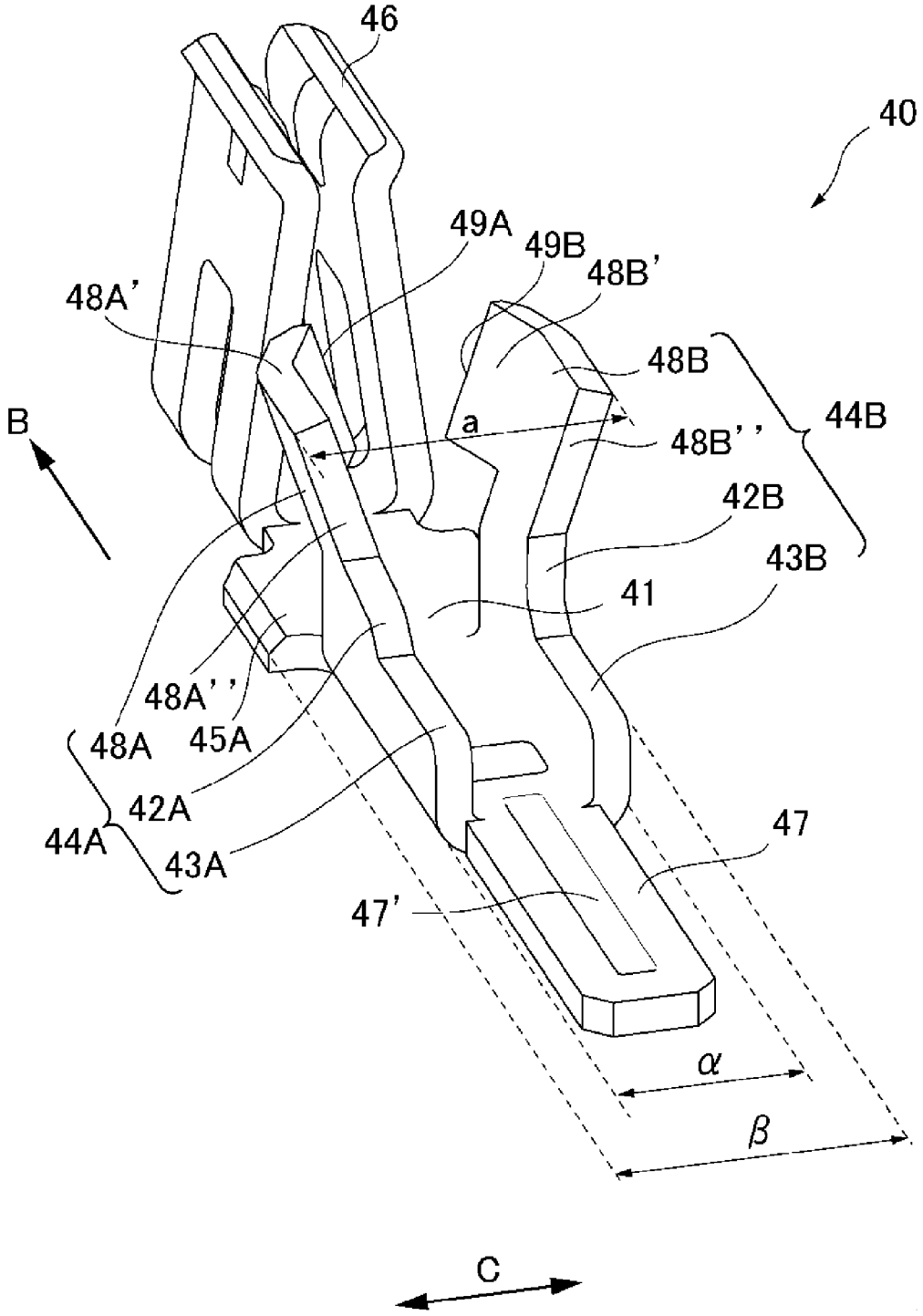
FIG. 9 is a rear-side perspective view of the contact member of the cable connector according to the embodiment of the present invention.

FIG. 9 shows a rear-side perspective view the contact member 40 as a component. Here, although it is not obvious from the drawings but each contact member 40 can be made from, for example, a nonmagnetic metal material such as beryllium copper. Such nonmagnetic metal material is considered as one of most suitable material for a magnetic inspection.

Each contact member 40 has a laterally symmetrical shape, and includes a basal section 41 that extends along the axial direction of the cable; a soldering section 47, which is provided on a side opposite an arrowhead side in the moving direction "B" relative to the basal section 41 and at least a part of which is disposed on the sliding surface 77; a pinching section 46, which extends on the arrowhead side in the sliding direction "B" relative to the basal section, from the basal section 41 side to the fitting side for fitting to the board connector 8, and is to be disposed on the sliding surface 77 with the basal section 41 etc.; elastic locking sections (sections to be locked) 44A and 44B, which are provided between the basal section 41 and the soldering section 47, while extending from the basal section 41 to the fitting side for fitting to the board connector 8 and are to be disposed on the sliding surface 77 together with the basal section 41 etc.; and wide-width sections 45A and 45B (not illustrated), which are formed at the basal section 41 so as to be wide in a direction crossing the moving direction (direction B in the figure) of the sliding movement and is to be disposed on the sliding surface 77 with the basal section 41. Any of the soldering section 47, the pinching sections 46, the elastic locking sections 44, and wide-width sections is disposed along the axial direction of the cable.

Each sliding surface 77 to dispose the basal section 41 thereon is formed on a tongue section 35 that extends from the housing slot 33 to outside. Each contact member 40 slides on the sliding surface 77.

Figure 10:
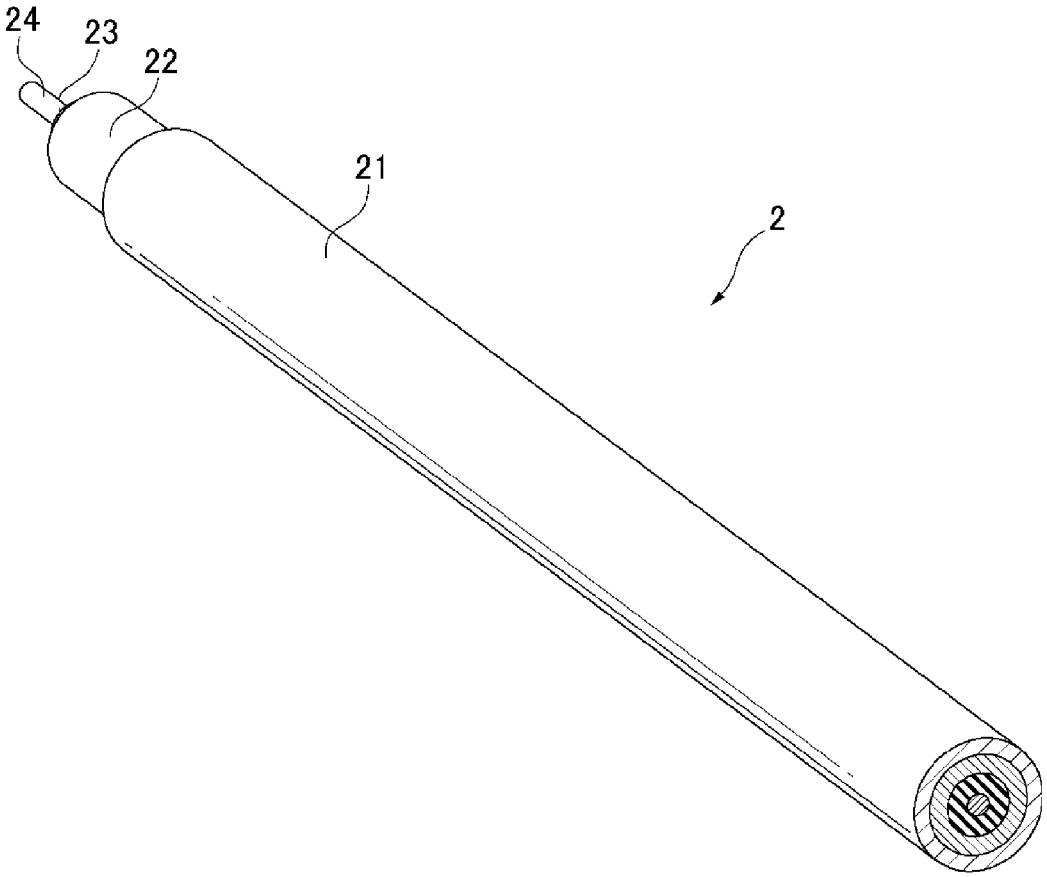
FIG. 10 shows a configuration of a coaxial cable to be connected to the cable connector according to the embodiment of the present invention.

FIG. 10 shows a perspective view of the coaxial cable 2. As well known, the coaxial cable 2 has a core wire 24 as its center; an insulation 23 that covers outside of the core wire 24; an outer conductor 22 that further covers outside of the insulation 23; and an outer sheath 21 on the outermost side. Onto the soldering section 47 of each contact member 40, the core wire 24 of the coaxial cable 2 is soldered.

In order to be able to securely solder the core wire 24, at a generally center part of the soldering section 47, there is provided a concave section 47' along the axial direction of the coaxial cable 2. Generally the whole part of each contact member 40 but other than the soldering section 47 is housed in the housing slot 33 (FIGS. 5 to 7, etc.) of the housing 30. As a result, it is possible to securely shield the contact member from the outside while being capable of soldering. A part of the soldering section 47 near an end thereof sticks out from the tongue section 35 (see FIGS. 5 to 7, etc.). With this configuration, space is provided on a side opposite the fitting side for fitting the cable connector 3 and the board connector 8. Providing the space 80, it is possible to release heat generated upon soldering, and reduce influence of heat on the housing 30, etc.

The pinching sections 46 are disposed generally right under the through hole 34 provided in each housing slot 33 when each contact member 40 is disposed in the housing slot 33 of the housing 30. Each pinching section 46 has elasticity and becomes widened by a flat contact member 90 of the board connector 8 upon fitting the cable connector 3 and the board connector 8, and clamps the contact member 90 therebetween. As such, the contact member 40 of the cable connector 3 and the contact member 90 of the board connector 8 contact to each other and remain contacted.

The elastic locking section 44 is composed of a pair of elastic locking sections 44A and 44B that face each other in a direction crossing the axial direction of the cable. Those elastic locking sections 44A and 44B can be formed, for example, by cutting sheet metal and lifting that portion. Using sheet metal, it is not only possible to produce the elastic locking section 44, but also possible to achieve sufficient strength. Each of the locking sections 44A and 44B has a generally square-bottomed V-shape in the sectional view.

Furthermore, each elastic locking section 44A and 44B includes a free end section 48A and 48B provided on arrowhead side in the sliding direction "B"; and a vertically rising section 43A and 43B that is provided on a side opposite the arrowhead side in the sliding direction "B" and generally vertically rises from the basal section 41; and a middle section 42A and 42 that connect therebetween. Especially, the free end section 48A and 48B is provided to extend from the basal section 41 towards the fitting side of fitting to the board connector 8 to a similar height level to that of the pinching section 46 in the same direction, so that sufficient spring length is secured in each elastic locking section 44A and 44B.

In addition, on each of the free end sections 48A and 48B, there is formed a surface 49A and 49B on the arrowhead side in the sliding direction "B". In addition, there is formed a surface 48A" and 48B" on a side opposite the arrowhead side in the sliding direction "B". As such, surfaces are provided on the arrowhead side in the sliding direction "B" and the side opposite the arrowhead side in the sliding direction "B". Accordingly, it is possible to obtain sufficient locking strength in an axial direction of the cable even in such a small contact member 40.

In addition, it is possible to downsize the device also in the axial direction of the cable. Here, corresponding to the pair of the elastic locking sections 44A and 44B, the housing 30 has a pair of vertical thick walls 79A and 79B, to which the elastic locking sections 44A and 44B are locked.

The vertically rising sections 43A and 43B that form the surfaces 48A" and 48B" opposite the moving direction B of the sliding movement has a width "α". In addition, similarly, the middle sections 42A and 42B and the free end sections 48A and 48B also has a width "α" on their basal section side 41. The width "α" is the same as or slightly smaller than the size "a'" (see FIG. 8) of the gap formed by the pair of facing thick walls 79A and 79B of the housing 30.

With such setting of the size, it is possible to smoothly guide each contact member 40, especially the basal section 41 side, to the housing 30. In addition, after placing each contact member 40 in the housing 30, by restricting the vertically rising section 43 of the elastic locking section 44 in a direction crossing the moving direction "B" of the sliding movement, it is possible to prevent displacement of the contact member 40 in a lateral direction relative to the housing 30.

On the other hand, a part extending out to the side for fitting with the board connector 8, especially the free end sections 48A and 48B have the maximum width "a" therebetween in a section extending out the most on a side opposite the arrowhead side in the sliding direction "B". The maximum width "a" is set larger than the width "α", which is the width therebetween on the basal section 41 side. In short, the gap "a'" of the thick walls 79A and 79B of the housing 30 is set smaller than the maximum width "a".

As a result, when the contact members 40 are placed in the housing 30, those free end sections 48A and 48B collide with inner walls 79A" and 79B" at surfaces 48A" and 48B", which are opposite the arrowhead side in the sliding direction "B". As a result, each contact member 40 is locked at the surfaces 48A" and 48B", which are portions provided on the side opposite the arrowhead side in the sliding direction "B", by the specified section of the housing 30.

Upon placing the contact members 40 in the housing 30, in order to smoothly guide the contact members 40 to the housing 30, the free end sections 48A and 48B have the guiding sections 48A' and 48B' on the arrowhead side in the sliding direction "B". Those guiding sections 48A' and 48B' are formed by respectively forming a curve towards the center. Upon attaching each contact member 40 to the housing 30, by having the guiding sections 48A' and 48B' collide with the tapered sections 79A' and 79B', which are provided on the thick section 79 of the housing 30, near the surfaces 49A and 49B, it is possible to smoothly guide the free end sections 48A and 48B, etc. into the housing 30.

Once the contact member 40 is guided in the housing 30 and the elastic locking sections 44A and 44B reach a certain position in the housing 30, i.e., the securing section 78 formed as a concave shape, with elastic action of the elastic locking sections 44A and 44B, the free end sections 48A and 48B are fitted in the securing section 78 of the housing 30. At this point, the free end sections 48 of the elastic locking sections 44A and 44B collide with certain portions of the housing 30, i.e., the surfaces 79A" and 79B" of the thick section 79, on a side opposite the arrowhead side in the sliding direction "B". Through this collision, it is possible to prevent coming off of the contact members 40 from the housing 30.

As described above, according to the configuration, while it is possible to smoothly attach the contact members and outer shells, it is also possible to securely maintain their attached state after the attachment of the contact members and the outer shells.

Corresponding to the wide width section 45 (45A and 45B), the housing 30 has a gap 37 formed along each sliding surface 77. Each wide width section 45 is inserted in the gap 37 of the housing 30 along the sliding surface 37, and supported between the sliding surface 77 and a pressing section 37' of the housing 30, which is provided on the fitting side for fitting the cable connector 3 to the board connector 8. In this case, the width "β" (see FIG. 9) of the wide width section 45 is larger than a width of an opening of the housing 30, i.e., a width "d" (see FIG. 8) of the pressing section 37' of the housing, so that the wide width section 45 has an overlapping section with the pressing section 37' of the housing 30 in the length section of "β-d". With the length section, it is possible to prevent the contact member 40 coming off to the fitting side of fitting the cable connector 3 to the board connector 8.

Figure 11:
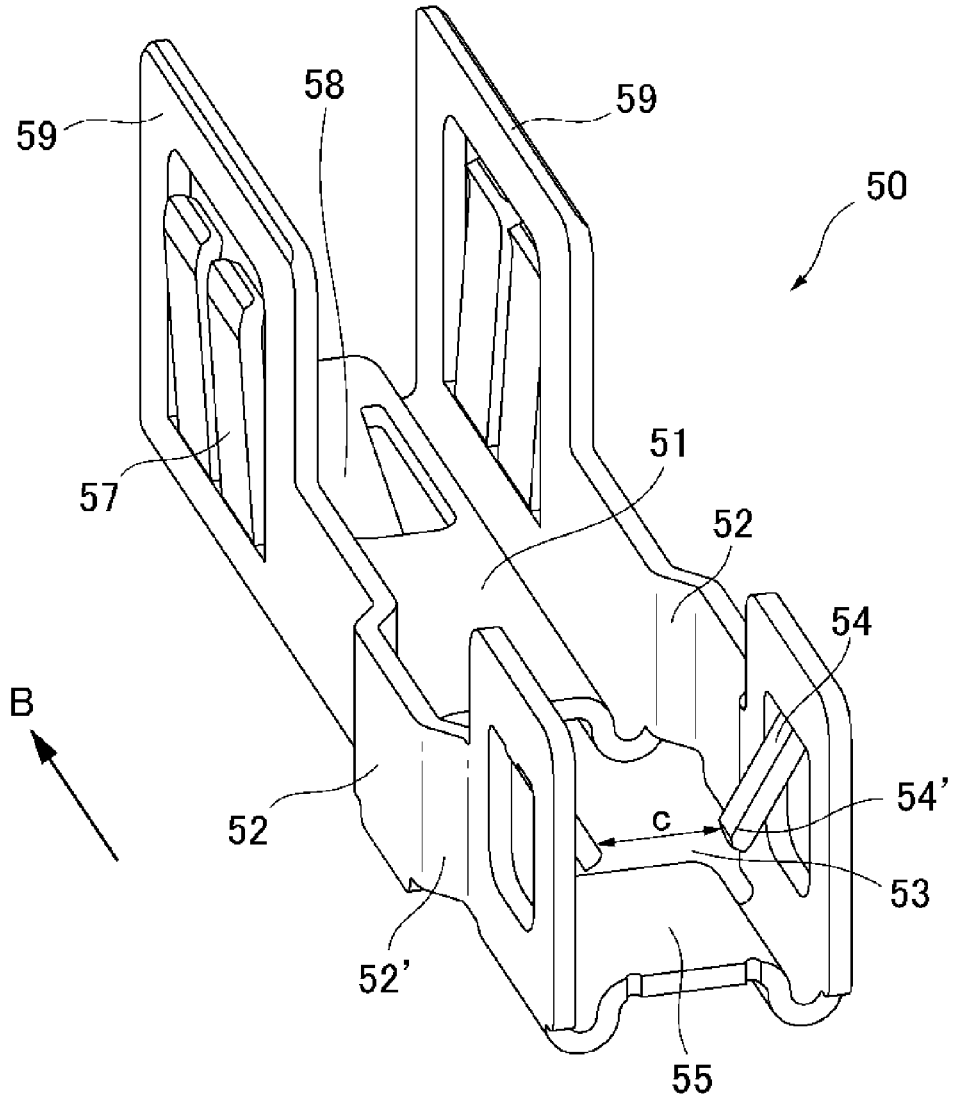
FIG. 11 is a rear-side perspective view of the outer shell showing the cable connector according to the embodiment of the present invention.
Figure 12:
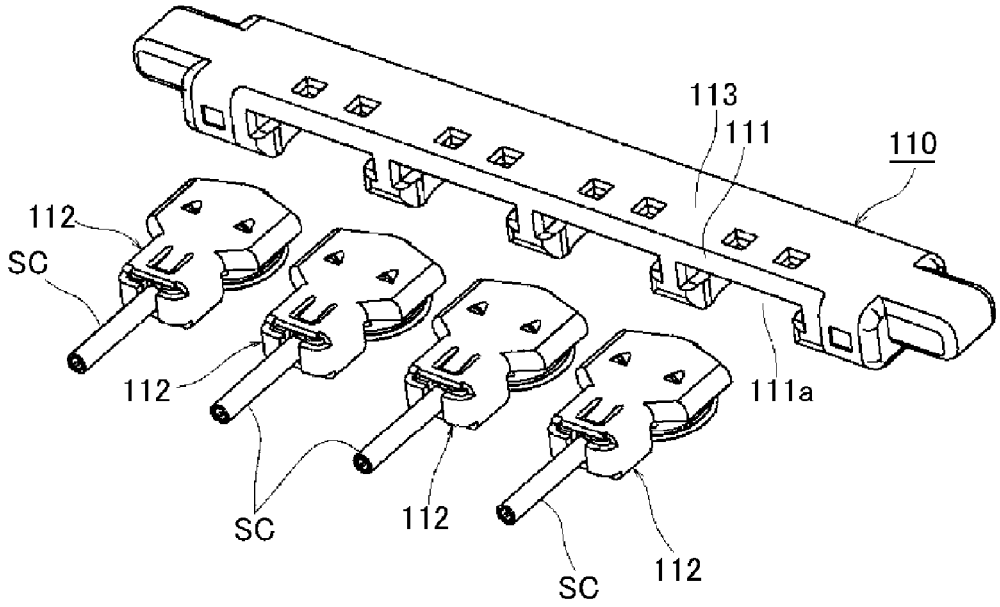
FIG. 12 is a perspective view showing a conventional electrical connector.
Figure 13:
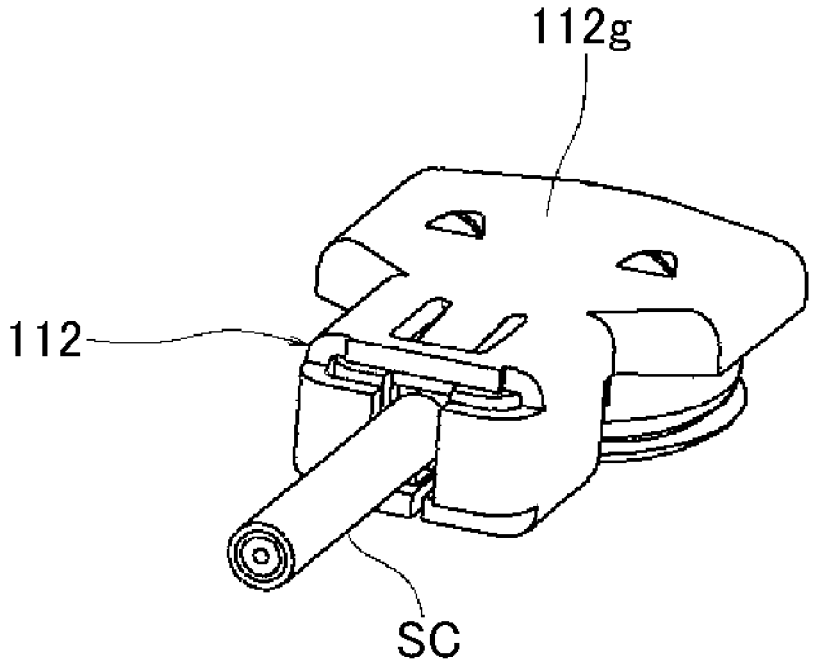
FIG. 13 Prior Art
FIG. 13 is a top rear-side perspective view of a conventional plug module of the conventional electrical connector.
Figure 14:
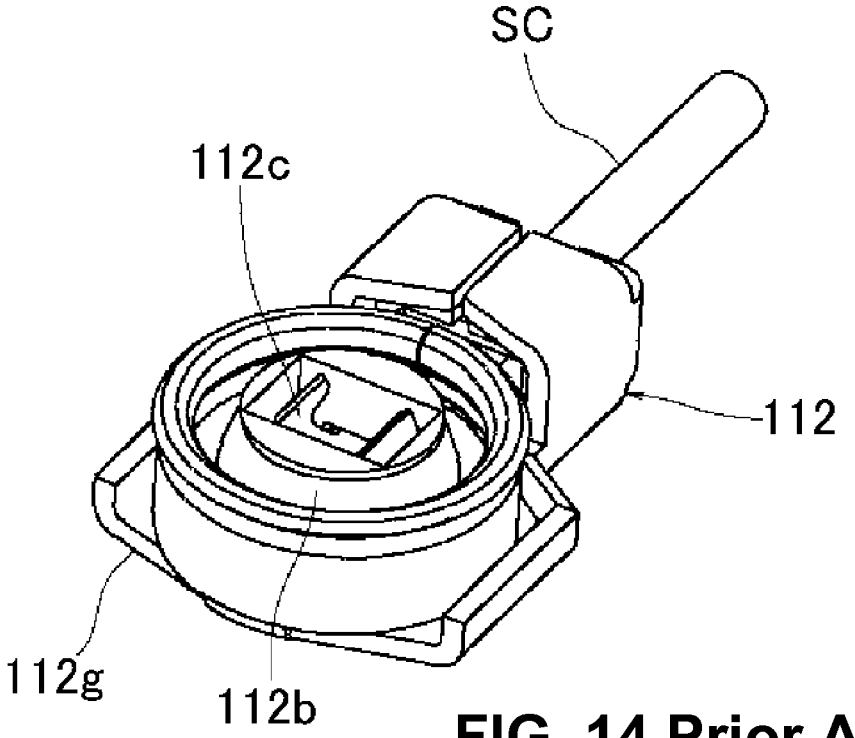
FIG. 14 Prior Art
FIG. 14 is a bottom rear-side perspective view of the conventional plug module of the conventional electrical connector.
Figure 15:
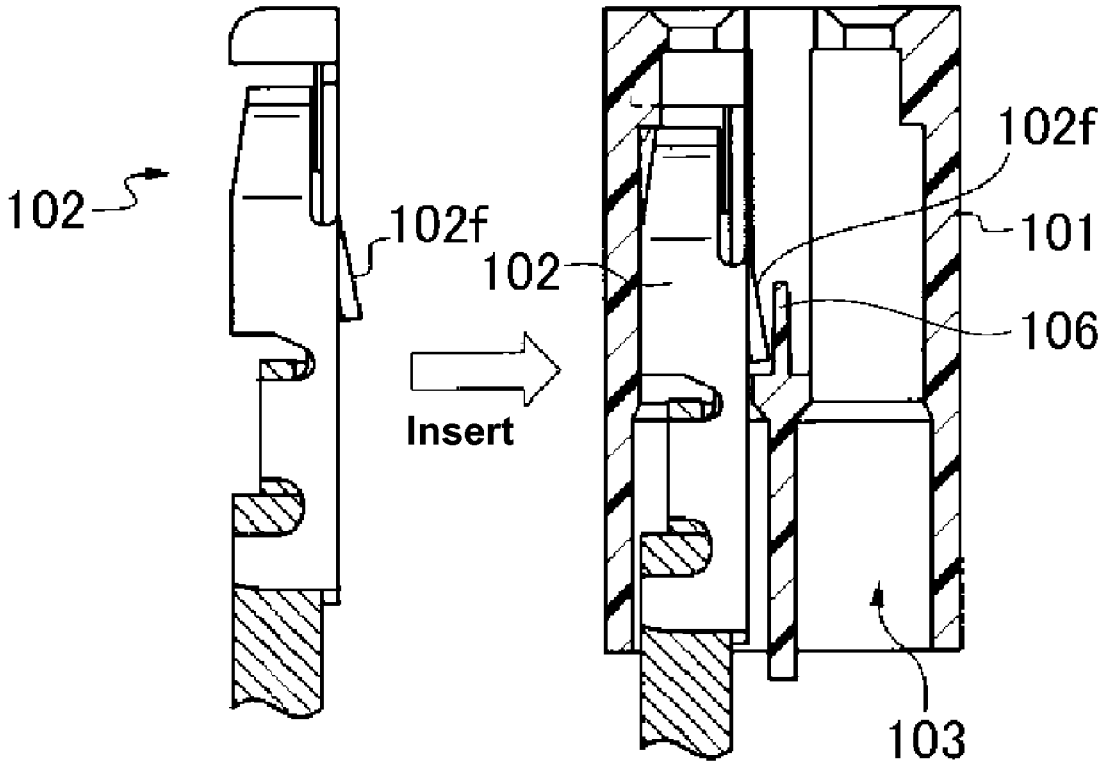
FIG. 15 Prior Art
FIG. 15 shows an example of a conventional contact locking configuration of the conventional electrical connector.

FIG. 11 shows a rear side perspective view of the outer shell 50 as a component. Similarly to the contact member 40, the outer shell 50 has a laterally symmetrical shape.

Each outer shell 50 includes a basal section 51 that covers a bottom surface of the housing slot 33; a side wall sections 59, each of which is provided to rise towards the fitting side of fitting the cable connector 3 to the board connector 8 and covers a side surface of the housing slot 33; side wall sections 52, which are provided to rise toward the fitting side of fitting the cable connector 3 to the board connector 8 while being continuous to the side wall sections 59 in the sliding section and cover the both sides of the soldering section of the contact member 40; support sections 54, which are provided on a side opposite the arrowhead side in the sliding direction "B" relative to the side wall section 52, form a generally square bottomed V-shape, and formed by cutting and lifting a part of the side walls; and a support base 55, which is provided on the bottom side, i.e., the side opposite the fitting side of fitting the cable connector 3 to the board connector 8 relative to the support sections 54.

On the arrowhead side in the sliding direction "B" relative to the basal section 51, there is provided a locking section 58, which is formed by cutting and lifting like a cantilever towards outside of the outer shell 50. As described above, the outer shells 50 are secured in the housing 30 in the longitudinal direction of the fitting surface 36. Therefore, with the locking section 58 displaced towards the through hole 32 (see FIG. 5) of the housing 30, it is possible to insert the locking section 58 of each outer shell 50 in the through hole using the sliding movement of the housing 30 and collide the end surface 58' to the specified wall surface 32' of the through hole 32. With this collision, it is possible to prevent the outer shells 50 from coming off from the housing 30.

Each basal section 51 is inserted along the gap 35' formed between the tongue section 35 and the upper surface 36'. On the other hand, the side wall sections 59 are inserted in the housing 30 along the gap 35" formed along the arrangement direction of the housing slots 33. As a result, among the housing slots 33 extending along the sliding movement, three surfaces, the surfaces other than the fitting surface 36, are covered with the outer shell 50. Here, after inserting those sections, there is a part of the housing 30 exist between the contact member 40, which is disposed inside of the housing slot 33, and the outer shell 50. Therefore, without providing an extra component, it is possible to electrically insulate between the contact members 40 and the outer shells 50.

On the side wall sections 59 on the front side (on the arrowhead side in the sliding direction "B"), it is preferred to provide elastic sections 57 that are displaced outward so as to be away from the housing slot 33. With the elastic sections 57, upon fitting the cable connector 3 to the board connector 8, the elastic sections 57 can elastically contact with the outer shells 92 of the board connector 8 and the grounding contact can be more secured.

Furthermore, the side wall sections 52 are preferably kept away from the soldering section 47 in comparison with the side wall sections 59, for example by providing bent sections 52' or the like. With this configuration, it is possible to have a large insulating distance between the core wire 24 of the coaxial cable, which is soldered to the soldering section 47, and the outer shell 50.

Each support section 54 supports the outer conductor 22 (see FIG. 10) of the coaxial cable 2. The support section 54 is soldered to the outer conductor 22. As a result, the outer conductor 22 is electrically connected to the outer sheath 50. With the support sections 54, it is possible to reduce displacement upon soldering the coaxial cable 2 and it is possible to stably solder the core wire 24 or the coaxial cable 2, etc. Here, a gap "c" (see FIGS. 8 and 11) of the ends 54' of the support sections 54 is preferably set, for example, generally the same as or smaller than a diameter of the outer conductor 22 of the coaxial cable 2. With the size, it is possible to support the coaxial cable 2 having a small diameter with the support sections 54. Furthermore, on the bottom side of the support sections 54, it is preferred to provide a support base 55. As such, even when it is not possible to support the coaxial cable 2 by the support sections 54 and the coaxial cable 2 is provided further below the support sections 54, it is possible to securely support the coaxial cable 2.

Here, according to the above-described embodiment, an example, in which the contact member 40 has the elastic locking sections 44, the wide-width section, etc., but the outer shell 50 can also have elastic locking sections and a wide-width section in a similar manner. Accordingly, the present invention also includes an embodiment in which elastic locking sections are provided in the outer shells 50.

In addition, the above-described embodiment is described with an example of the coaxial cable, but the present invention is applicable to, for example, typical electric cable, etc. Therefore, the cable described herein is not limited to the coaxial cable. Furthermore, connection of the cable with the contact member 40 and the outer shell 50 can be made by other connecting method such as crimping, as well as by soldering.

The disclosure of Japanese Patent Application No. 2012-284340 filed on Dec. 27, 2012, is incorporated in the application by reference.

While the invention has been explained with reference to the specific embodiments of the present invention, the explanation is illustrative and the invention is limited only by the appended claims.

What is claimed is:

1. An electrical cable connector to be connected to a cable and a mating connector, comprising:

a housing including a vertical wall protruding from an inner surface of the housing, said vertical wall including a thin wall section and a thick wall section; and a contact member disposed in the housing to be electrically connected to the cable, wherein said contact member includes:

a base portion extending in an axial direction of the cable;

a connecting portion disposed on one side of the base portion in the axial direction of the cable and to be connected to the cable, said connecting portion being formed in a flat plate shape;

a pinching section disposed on the other side of the base portion in the axial direction of the cable to contact with a mating contact portion of the mating connector, said pinching section extending in a direction perpendicular to the axial direction; and an elastic locking section disposed between the pinching section and the connecting portion in the axial direction of the cable and extending from the base portion, said elastic locking section extending in the direction perpendicular to the axial direction, wherein said elastic locking section is formed of a pair of elastic engaging pieces facing each other, said elastic engaging pieces extend upwardly away from each other so that a distance in between increases away from the base portion, said thick wall section includes a pair of thick wall portions, said thick wall portions are arranged apart with a distance smaller than a maximum distance between the elastic engaging pieces so that the elastic engaging pieces engage with the thick wall portions, said contact member further includes a wide width portion formed in a flat plate shape and disposed between the pinching portion and the elastic locking section in the axial direction, and said housing includes a space for accommodating the wide width portion.

2. The electrical cable connector according to claim 1, wherein said elastic engaging pieces have a sectional shape apart from each other upwardly.

3. The electrical cable connector according to claim 1, wherein said elastic engaging pieces are formed of a cut portion of a metal plate.

4. The electrical cable connector according to claim 1, wherein said housing includes a receptacle space for accommodating the base portion, the pinching section, and the elastic locking section of the contact member.

5. The electrical cable connector according to claim 1, wherein said connecting portion is configured to be connected to the cable with solder.

6. The electrical cable connector according to claim 1, wherein said contact member is disposed at a plurality of positions in the housing.

7. A connector device comprising the electrical cable connector according to claim 1 and the mating connector.

8. The electrical cable connector according to claim 1, wherein said housing further includes a securing section formed in a concave shape, and said securing section is situated adjacent to the vertical wall so that the elastic locking section is accommodated in the securing section.

9. The electrical cable connector according to claim 1, wherein said thin wall section includes a pair of thin wall portions, and said thin wall portions are arranged apart with a distance smaller than a width of the wide width portion so that the wide width portion engages with the thin wall portions.

10. The electrical cable connector according to claim 1, wherein said contact member is disposed in the housing to be electrically connected to the cable including a coaxial cable.

11. The electrical cable connector according to claim 10, further comprising an outer shell fixed to the housing and to be connected to an outer conductive member of the coaxial cable.

12. The electrical cable connector according to claim 11, wherein said contact member and said outer shell are configured to be fixed to the housing when the contact member and the outer shell are moved along the axial direction of the cable.

13. The electrical cable connector according to claim 11, wherein said outer shell includes a side wall portion for covering the connecting portion.

14. The electrical cable connector according to claim 11, wherein said outer shell includes a supporting piece for supporting the cable.

15. The electrical cable connector according to claim 11, wherein said outer shell includes a supporting base for placing the cable.

* * * * *